US008795014B2

(12) United States Patent
McCarthy

(10) Patent No.: US 8,795,014 B2
(45) Date of Patent: Aug. 5, 2014

(54) WORKOUT RAFT

(75) Inventor: Chicky-Jeanne McCarthy, Port Salerno, FL (US)

(73) Assignee: Chicky-Jeanne McCarthy, Vero Beach, FL (US)

( * ) Notice: Subject to any disclaimer, the term of this patent is extended or adjusted under 35 U.S.C. 154(b) by 68 days.

(21) Appl. No.: 13/615,223

(22) Filed: Sep. 13, 2012

(65) Prior Publication Data

US 2014/0073209 A1 Mar. 13, 2014

(51) Int. Cl.
*B63B 35/74* (2006.01)

(52) U.S. Cl.
USPC ..... 441/129; 441/41

(58) Field of Classification Search
USPC ..... 441/129, 35, 40, 41; 482/111; 5/708, 5/710, 706, 722, 725, 638, 652
See application file for complete search history.

(56) References Cited

U.S. PATENT DOCUMENTS

| | | | | | |
|---|---|---|---|---|---|
| 2,369,736 | A * | 2/1945 | Hurt | 5/708 |
| 4,634,393 | A * | 1/1987 | Wood | 441/129 |
| 4,723,329 | A * | 2/1988 | Vaccaro | 5/710 |
| 4,824,411 | A * | 4/1989 | McClanahan | 441/129 |
| 4,876,756 | A * | 10/1989 | Vaccaro | 5/710 |
| 5,090,695 | A * | 2/1992 | Ciolino | 441/129 |
| 5,679,040 | A * | 10/1997 | Bianchi-Holm | 441/129 |
| 7,648,449 | B1 * | 1/2010 | Detert | 482/111 |

* cited by examiner

*Primary Examiner* — Lars A Olson

(57) ABSTRACT

Disclosed is a flotation platform engineered to permit aquatic based exercise routines in a pool or Shallow calm waters for fitness or rehabilitation. An exercise method directed for a total body workout. A raft that exercise routines are performed on water to reduce stress, as if compared to ones workout With heavy equipment or on hard surfaces. The workout raft includes a removable pillow to allow more Resistance for both upper and lower body. The raft includes flexible connectors for the arm rest for a Variety of arm exercises. The raft includes a quarter hole behind the users knees to allow the user to Bend the raft easily in and out of the water. Disclosed is a raft that works out about every part of the Body. It has a number of color coded chambers that can be inflated for the desired level of resistance.

15 Claims, 5 Drawing Sheets

WORKOUT RAFT

FIELD OF INVENTION

The present invention relates to a floating device for use in a pool or shallow calm waters. It is a floatation platform engineered to permit aquatic based exercise routine for fitness and rehabilitation. More particularly, the invention is a raft that contains a color coded chamber system inside the apparatus that provides a variety of exercises as well as comfort. The present invention provides a means of an inexpensive and personal work out. It provides a full body workout without any undue stress having to do with heavy equipment and costly devises that take up a lot of room. It provides a minimal amount of set up and a great water tension workout.

BACKGROUND ART

There are a number of prior art devices using mats and/or flotation devises. Prior art devices generally do not permit independent exercise routines of various muscle groups such as arms, abs, and legs. Nor do the permit independent variations of a resistance program, while floating on the water. There are however other prior art devises that are based primarily for tubs or other constricted areas. This feature will show you that this invention is not limited to size such as bathtub devices. Such bathtub devices are limited to the size of the operator. These features of the present invention will be provided for the user with no restrictions.

DESCRIPTION OF RELATED ART

Water flotation devices are well known in the art including life vests, tubes, boards and "water-wings." However, none of the known devices are adapted for the use of exercises while on the water, since all interfere with the arms, the legs, or both. Also, some of them do not ensure that the head is kept above water without some action by the arms or legs.

BACKGROUND OF THE INVENTION

Exercising is universally pursued for aerobic fitness, maintaining Muscle tone, improving posture, and rehabilitation. Swimming Or other aquatic activities have long been favorites for such purposes mostly due to low impact nature of such exercise. The muscle activities in swimming puts little or no strain on limb joints while providing a significant cardiovascular workout.

There are however, several drawbacks to swimming as a means for exercise. For many swimming is difficult or impossible due to fear or no prior experience. Depending on the individual swimming may involve too much strain or work.

The present invention provides a unique solution to these problems By allowing a controlled set of exercise movements, while having the protection of the float, in a gravity free environment. Similar to swimming but the comfort and protection for a total body workout.

Additionally, the problem with exercise in general is that most people Just don't have the time and finances. Cost is a major factor affecting the Decision to exercise or not, since the health dubs and spas charge Mostly fees far in excess of what the typical citizen can afford now a days. Another problem with the gym for the beginner is all the overwhelming heavy equipment and how to operate them and for how long. You would most likely have to hire a personal trainer to achieve the best gym workout, which is also very costly.

Addressing both problems the present invention provides an affordable one time price and simple instructions on how to use. The raft consists of color coded chambers that can be easily inflated, with any standard foot pump, to the desired level of resistance. It also allows one to have a private work out, whether it is at home in the pool or vacation resort. It can easily be deflated and put into the water proof carry bag.

SUMMARY OF THE INVENTION

It is an object of the present invention to provide a flotation device which can function for both recreational and physical development purposes. It is therefore an object of the present invention to provide a device for use in the water that supports the user above the water's surface. It is an additional object to provide such a device that does not hamper user's movement. It is another object to provide such a device that does not require straps or belts. The exercise devise comprises a material adapted for floating that provides sufficient buoyancy to support a user positioned in a body of water. The method of the present invention comprises the steps of providing an adequate exercise program as outlined below.

DISCLOSURE OF THE INVENTION

The present invention is an aquatic exercise platform and a method of using the platform which allows one to enjoy total body fitness, strength and toning workout focused on just about every part of one's body while floating in a shallow pool, or shallow calm waters. The structure of the work out raft comprises primarily of a pool raft with attached arm rests. The float consists of a number of color coded chambers within the float that can be inflated to the desired level of resistance. The entire raft is comprised of a material capable of providing buoyancy. The float is a comfortable raft that has color coded chambers inside the main cylinder that inflates the entire raft. The arm rest are then inflated separately. These main compartments are first inflated to enable the apparatus to float and support the operator.

The apparatus provides support and buoyance once the main raft and arm rests are inflated to its entirety. This is accomplished by applying air through the individual valve for the arm rests and the main raft. Once this is accomplished, then one can inflate the individual color coded chambers inside the arm rests and main raft. A beginner for ex: might inflate just 2 color coded chambers as the advanced workout would inflate more color coded chambers. This also is achieved by inflated the desired color coded chambers for that specific workout, for ex: if a beginner is doing an abs workout then they would inflate the minimum top color coded chambers first maybe 2, then 3, 4, and so on. As well as the leg exercises, for ex; the beginner would Inflate the least amount of color coded bottom chambers and work their way up to more inflated chambers as the exercise got easier. Ex: The beginner would leave the two outer color chambers inflated at all times and then inflate either 2, 3, 4 and so on as the exercise got easier. The beginner may just be comfortable with the least amount of color coded chambers inflated as would an advanced workout. The more advanced the workout the more color coded chambers are inflated.

The present invention is an aquatic raft that works out a variety of muscle groups. The raft is comprised of one float that has upper and lower color coded chambers and arm rests for the arm exercises. The raft has a quarter hole behind the user's knees to allow the raft to bend into the water and out of the water. Without this feature it would be ultimately impossible to bend the raft. Also, the quarter hole also provided a number of leg exercises when the user is lying on the stomach and by placing the feet and legs through hole one then puts feet into the stirrups and pulls up on the mat for various leg exercises such as calves and hamstring. Flexible bands attached to the raft allow the arm rests full movement for a number of arm exercises such as biceps and forearms and deltoids. They are attached also to the mat only at one end enabling them to be moved to any angle with respect to the mat.

The present invention is primarily a float designed to provide a means of exercising while on the water. The mat includes a plurality of compartments that are inflated to a desired level to adjust the Resistance obtained when a portion of the mat is submerged into the water by the operator.

It is an object of the present invention to provide a recreational flotation device containing a plurality of compartments which may be inflated to the degree that maximizes the users comfort or the degree desired to carry out specific exercises.

The present invention shows various color coded chambers inside the main raft. Regardless how may chambers are inflated the raft will still provide support for the user seeing that the chambers are surrounded by the main raft. Thus letting the operator then inflate each color coded cylinder to the most comfortable resistance. Once the desired color coded chambers are inflated the operator then proceeds to push the mat into the water and slowly rising to the surface which gives the burn needed to build muscle and tone body. This is repeated for the arm rests as well once the desired chambers are inflated then the user pushes arm rests into the water and slowly brings back to surface. Other arm exercises can also be performed by holding on to the hand grips and pulling the arm rests out of the water towards the user for ex: to workout biceps and deltoids. Depending on the angle in which the arm rest in accordance to the mat will depend on the exercise needed for that particular workout. This is also true for the leg work out once the desired amount of color coded chambers are inflated, and while on ones back, the operator then pushes the apparatus into the water and slowly rising to the surface to give the complete workout and burn needed to get the degree of the leg exercise. Again while lying on ones stomach and the right amount of color coded chambers are inflated the operator then pulls up on the mat towards the gluts Maximus and slowly back down to the surface. When I first moved to Florida I was a single parent with 3 Jobs, I never had time to work out. I had a pool and I noticed my neighbors and friends had pools and really didn't use them. I had made a raft similar described here in my garage and used it to work out in my pool. Friends came by and wanted one and said that it was a great idea. I never got around working on this until now. I never really had the money for a patent attorney but I did a lot of research to write this article, I hope I can be successful and help other people with the exercise raft.

DETAILED DESCRIPTION OF THE DRAWINGS

FIG. 1 is the end view of the present invention, which shows the inventions pillow and the end chambers in the apparatus that includes a mat 1A arm rest and abs handle and foot stirrup.

BRIEF DESCRIPTION OF THE DRAWINGS

FIG. 1 of the present invention shows the ab handles 1C which allows the user to pull up on the raft for a variety of ab, stomach, and back exercises. FIG. 1-1A shows the side view of armrest that allows the user to do a variety of arm exercises. FIG. 1-1D are the foot stirrups that allows the user to lie on their stomach placing the feet through the quarter hole (FIG. 2-4A) and placing the feet into the stirrups for a variety of leg exercise such as hamstrings and calves.

figure to shows the movable hinges for arm rests 3A-3B allowing the arm rest full range of movement for a variety of arm exercises.

Figure 1:
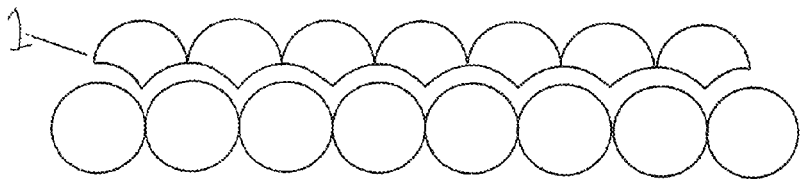
FIG. 1 is the end and side view of the present invention to show the end view of the pillow (FIG. 1-1) fitting onto the end view of the raft.
Figure 1:
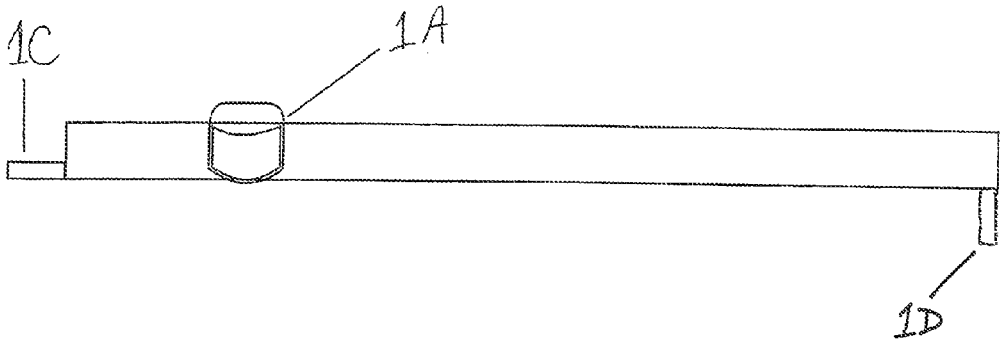
Figure 2:
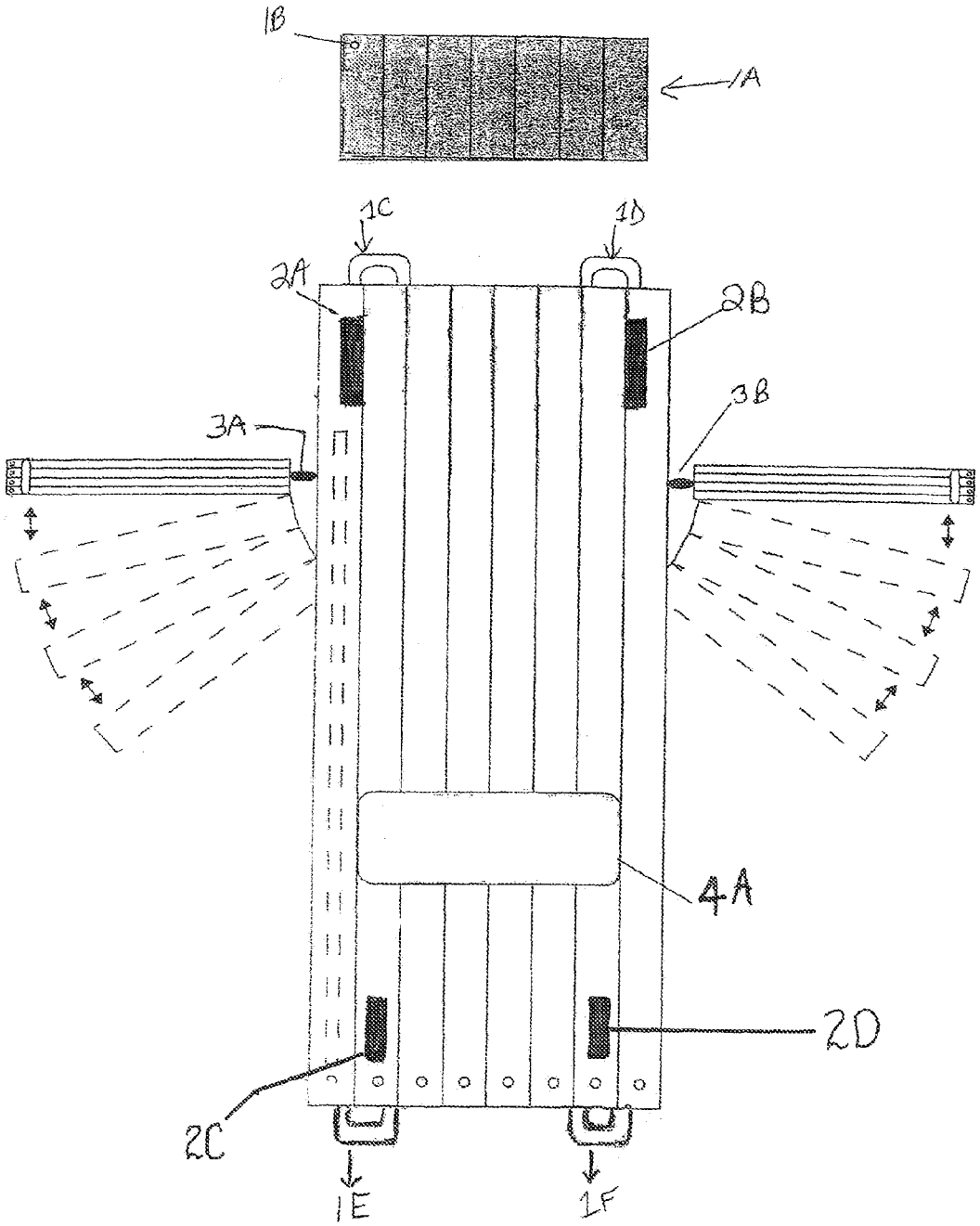
FIG. 2 shows the removable pillow 1A which allows for more resistance when placed on the bottom of the raft that is secured with the Velcro tabs (FIGS. 2-2C right and 2D left).
Figure 3:
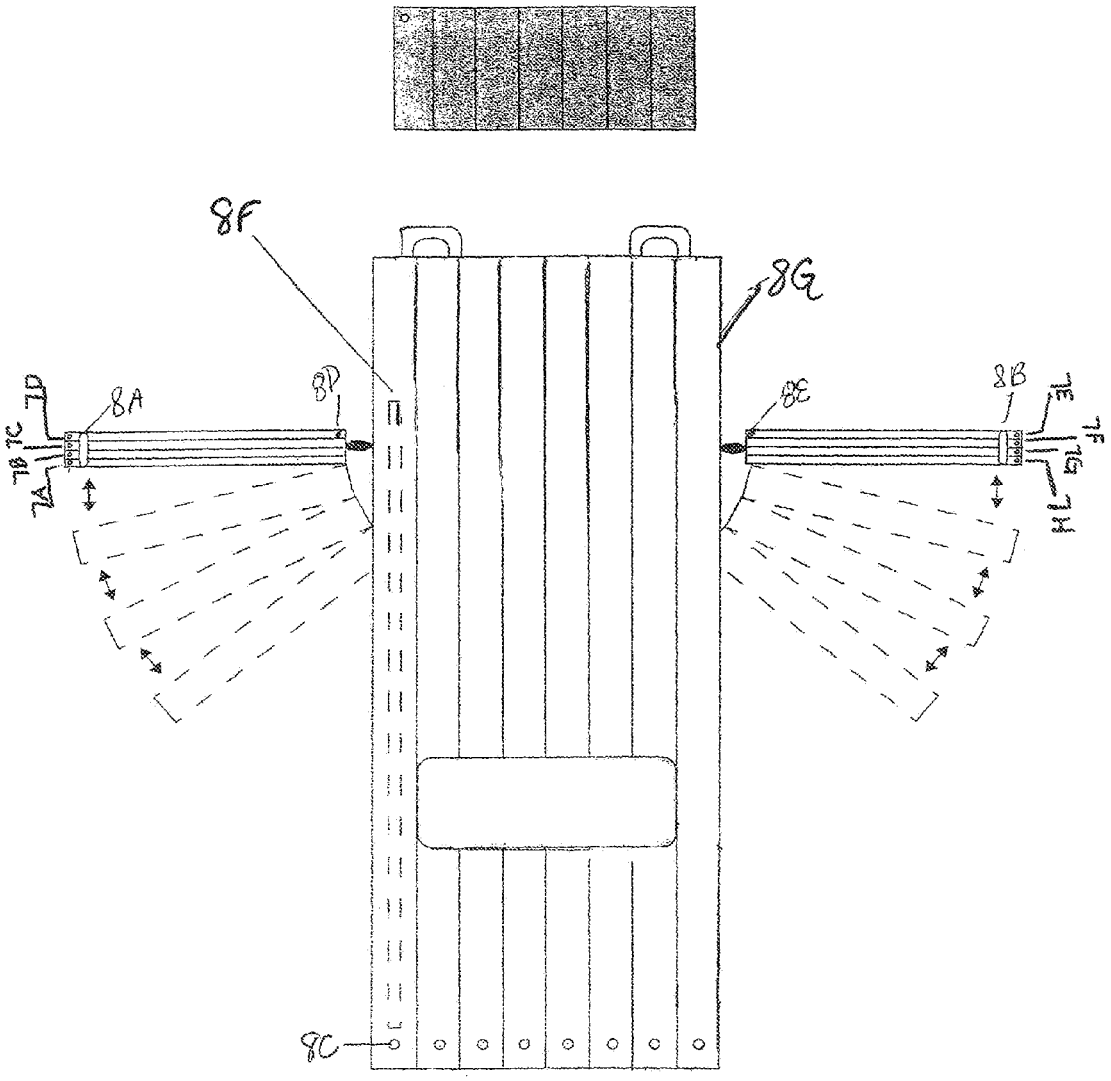

FIG. 3 shows the color coded chambers inside the raft 8F-8G these chambers are fully inflated once The main raft is inflated. FIGS. 3-8F and 8G stay inflated as well as the main raft cylinder to provide Adequate buoyancy and support for the user.

FIG. 3-7A,B,C,D is showing the right air valves that inflate the color coded chambers for different Degrees of resistance for various arm exercises.

FIG. 3-8D,8E are the main air valves to inflate the arm rests to ensure the arm rests float before Filling the color coded chambers.

Figure 4:
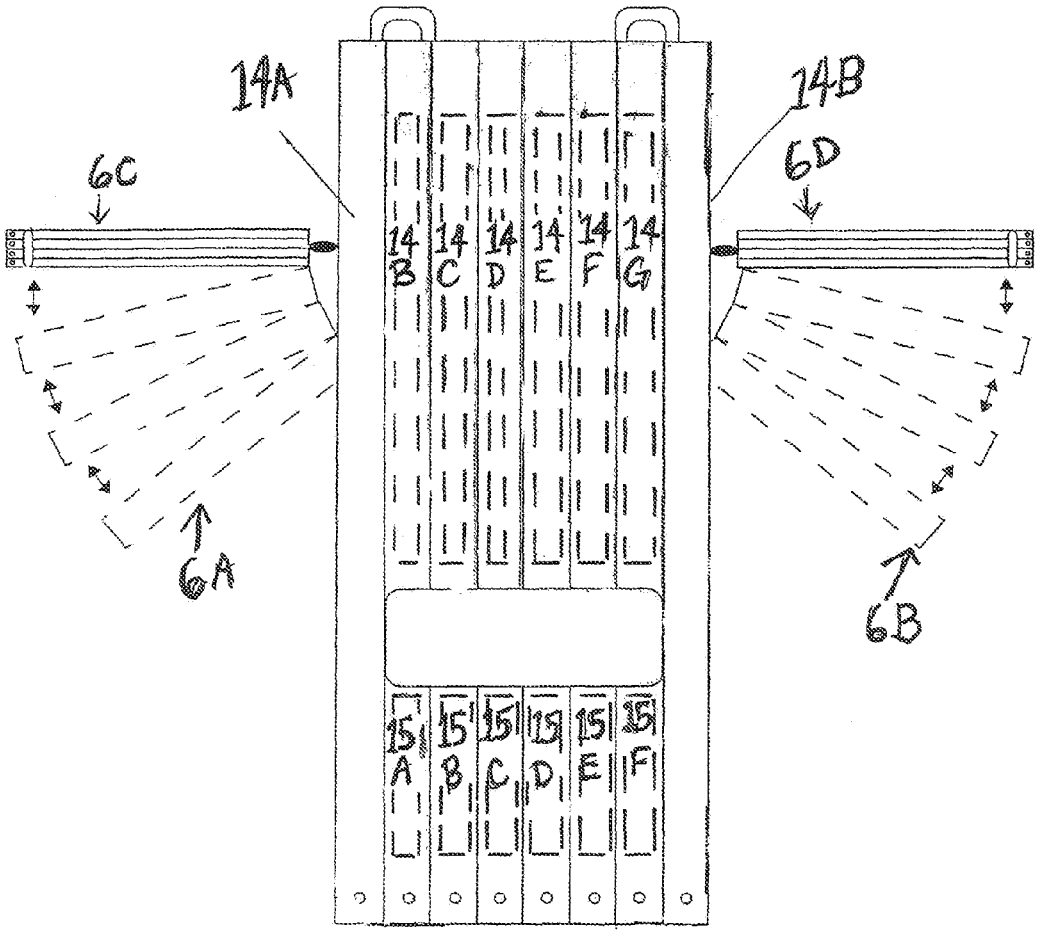

FIG. 4 of the present invention to show the range of movement for the arm rests 6A-6B.

FIG. 4 is to show the color coded chambers inside the cylinder of the main raft. FIG. 4-14B,14C,14D,14E,14F,14G are showing the color coded chamber system. This system helps adjust The tension in the raft for the minimum or maximum workout. The tower color coded chamber in FIG. 4-15A,15B,15C,15D,15E,15F are for different degrees of tension when inflated for a variety of leg exercise. The raft, while being just a basic raft, also transpires into a full body workout while the floating on top of the water just by adjusting the various color coded chambers. As the user inflates these chambers it allows the user for a personalized workout, whether it's a beginner or advanced. The more color coded chambers that are inflated in FIG. 4 the harder the exercise becomes.

Figure 5:
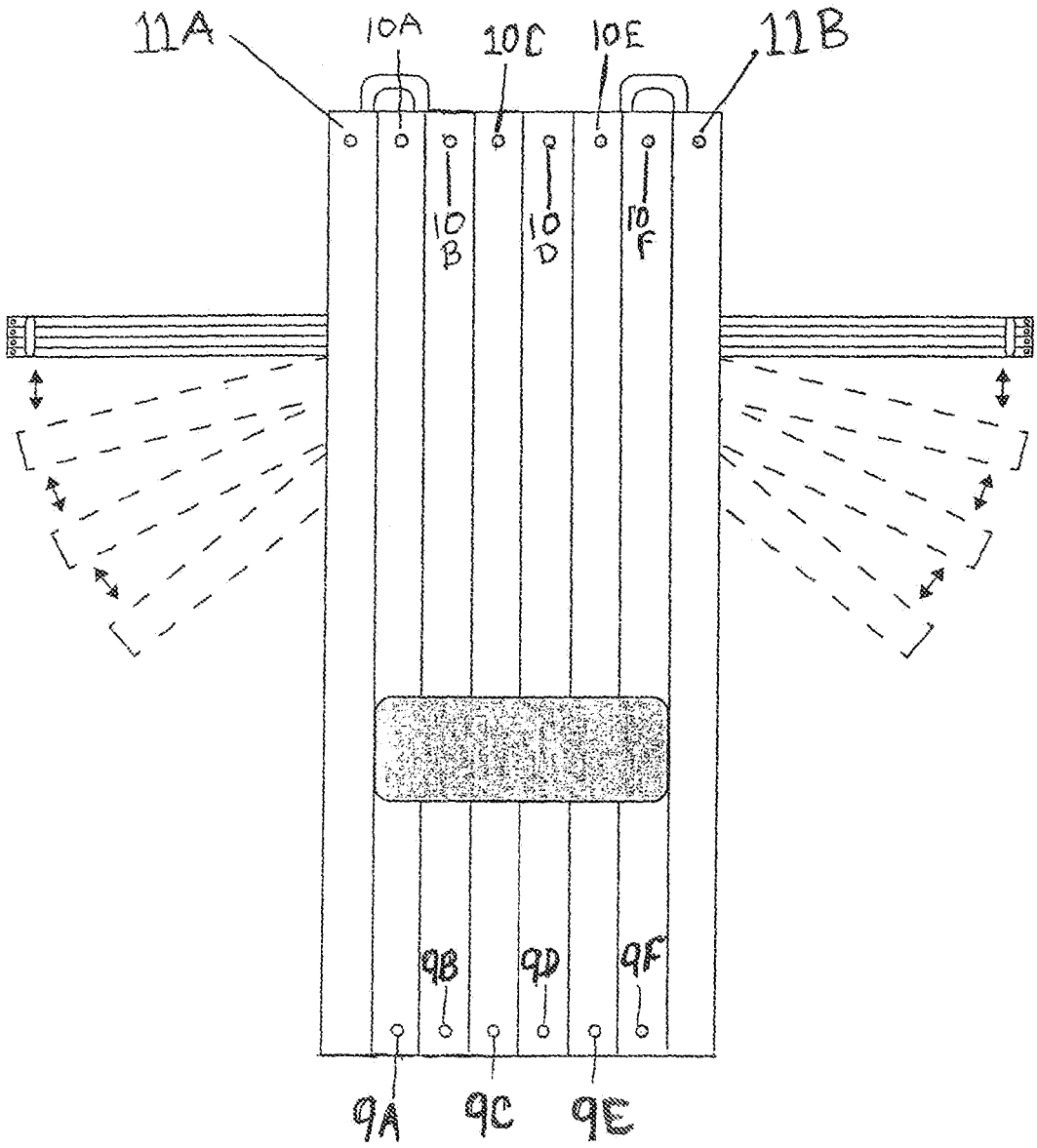

FIG. 5 is the back view of the present invention to show all the individual air valves for the color coded chamber system—10A,10B,10C,10D,10E,10F are showing the upper air valves to inflated the inside color coded chamber system. Each valve is attached only to the chamber on the back of the raft. The more upper chambers that are inflated the harder the workout. FIG. 5-9A,9B,9C,90,9E,9F is showing the air valves for the lower portion of the back of the raft to inflate the chambers inside the rafts cylinder.

While showing each Figure and its uses, the raft provides an all around workout as well as comfortable.

The invention claimed is:

1. A raft for providing a way to exercise in a pool or water; a color coded chamber system that can be inflated to a desired level of resistance, there are six chambers located in upper and lower portions of the raft, as well as four color coded chambers in each arm rest; a quarter hole behind a user's knees to provide flexibility to the raft as well as a variety of exercises; there are handles at upper and lower portions of the raft that provide grips for the user; hook and loop fasteners that connect arm rests; and a detachable pillow that allows more resistance for the upper and lower portions of the raft; hook and loop fasteners allow the detachable pillow to connect to the raft.

2. The raft of claim 1 that is designed to float on water extending from head to toe of the user.

3. The raft of claim 1 that is designed with a color coded chamber system with six individual chambers in the upper and lower portions of the raft.

4. The raft of claim 1 that is designed with two outer chambers that are inflated from top to bottom.

5. The raft of claim 1 that includes a plurality of handles at the upper portion of the raft to allow the user to perform exercises.

6. The raft of claim 1 that includes a plurality of stirrups on the bottom portion of the raft to allow the user to perform exercises.

7. The raft of claim 1 that is designed with a pair of detachable arm rests each with a hook and loop fastener.

8. The raft of claim 1 that is designed with hook and loop fasteners to secure the detachable pillow on the upper portion of the raft.

9. The raft of claim 1 that is designed with hook and loop fasteners to secure the detachable pillow on the lower portion of the raft.

10. The raft of claim 1 that is designed with a four color coded chamber system in the arm rests that is removable.

11. The raft of claim 1 that has handles attached to each arm rest for the user to grip for various arm exercises.

12. The raft of claim 1 that is designed with a quarter hole behind the user's knees to allow the raft to bend.

13. The raft of claim 1 that includes air valves at the upper and lower portions of the raft.

14. The raft of claim 1 that includes air valves at the lower portion of the arm rest.

15. The raft of claim 1 that includes air valves for each color coded chamber to inflate individually.

* * * * *